US006382383B1

(12) United States Patent
Schennach

(10) Patent No.: US 6,382,383 B1
(45) Date of Patent: May 7, 2002

(54) SAFETY DEVICE FOR THE CONTROL ELEMENTS OF A MANUALLY OPERATED SOIL COMPACTION ROLLER

(75) Inventor: Hermann Schennach, Dietersheim (DE)

(73) Assignee: Wacker-Werke GmbH & Co. KG, Munich (DE)

( * ) Notice: Subject to any disclaimer, the term of this patent is extended or adjusted under 35 U.S.C. 154(b) by 0 days.

(21) Appl. No.: 09/582,365

(22) PCT Filed: Jan. 8, 1999

(86) PCT No.: PCT/EP99/00079

§ 371 Date: Jun. 21, 2000

§ 102(e) Date: Jun. 21, 2000

(87) PCT Pub. No.: WO99/37862

PCT Pub. Date: Jul. 29, 1999

(30) Foreign Application Priority Data

Jan. 20, 1998 (DE) ..... 198 02 007

(51) Int. Cl.[7] ..... E01C 19/26; F16P 3/12

(52) U.S. Cl. ..... 192/129 R; 74/473.15; 74/473.3; 172/42; 172/528; 180/19.1; 404/122

(58) Field of Search ..... 192/129 R, 48.1, 192/48.92; 172/42, 528; 180/19.1, 19.3, 271, 272, 274; 404/122; 74/473.15

(56) References Cited

U.S. PATENT DOCUMENTS 3,147,818 A * 9/1964 Howard et al. ..... 180/19.1
4,573,543 A * 3/1986 Battaille ..... 180/19.1
4,799,398 A * 1/1989 Asano ..... 74/473.3

FOREIGN PATENT DOCUMENTS

DE 41 29 915 A1 10/1992
EP 0 593 063 A1 4/1994

* cited by examiner

*Primary Examiner*—Richard M. Lorence
(74) *Attorney, Agent, or Firm*—Boyle Fredrickson Newholm Stein & Gratz S.C.

(57) ABSTRACT

The invention relates to a safety device for the manually operated soil compaction roller, comprising an operating lever and an adjusting element coupled to an actuator in order to drive said roller. In case of danger, a safety-control element travels in between the adjusting element and the operating lever and separates the positive coupling, whereupon the adjusting element swings into a neutral position and shuts down the machine. When the operating lever swings forwards, a command corresponding to a forward movement is transmitted to the drive mechanism of said roller via a second positive coupling.

7 Claims, 7 Drawing Sheets

SAFETY DEVICE FOR THE CONTROL ELEMENTS OF A MANUALLY OPERATED SOIL COMPACTION ROLLER

BACKGROUND OF THE INVENTION

1. Field of the Invention

The invention relates to a safety arrangement for a manually guided soil compaction roller.

2. Description of the Related Art

In such soil compaction rollers, in particular rollers which are run with an operator in attendance, the operator walks behind the roller and controls it via a handle, which is fastened to a pole and has a travel lever for setting the travel speed and direction. The roller is normally moved via a hydraulic unit in forward direction and reverse direction, that is toward the operator.

A safety arrangement, often also referred to as dead man's circuit, serves in such soil compaction rollers to switch off the propulsion of the roller if the roller moves backward, i.e. in the direction of the operator guiding the roller, and the operator himself can no longer move backward or cannot escape from the roller. This problem may occur, for example, if the operator walks backward with the roller into an obstacle, gets into a panic and consequently forgets to stop the roller or move it in the opposite direction.

An actuator which is able to register the fact that the roller runs against an obstacle, for example the operator, is therefore provided in known safety arrangements. To this end, the safety arrangements have an actuator which is displaceable between an operating position and a hazard position and, if the operator comes into contact with it, is displaceable out of the operating position into the hazard position and consequently stops the roller.

To this end, it is stipulated in standards that, after the response of the safety device, the stopping travel of the roller must be smaller than the remaining operating travel of the actuator after the roller is switched off in order to avoid squeezing the operator.

DE-A 41 29 915 A1 discloses a safety arrangement in which the travel speed and direction can be set via a travel lever. The roller is guided via an additional handle, which is vertically pivotable like a lever and can be pivoted from an upswung basic position down into a working position in which its free end is still clearly above the horizontal established by its pivot. The travel lever, otherwise held in neutral position by spring loading, is fixed in the desired deflected position in a positive-locking manner by swinging down the handle. When the handle is swung up, which is effected automatically, for example, if the handle comes into contact with an obstacle, the positive-locking connection is neutralized, as a result of which the travel lever moves into the neutral position in a spring-loaded manner and stops the roller. Movement of the roller in the opposite direction is possible by further actuation of the travel lever.

In such solutions, it is always possible to reach the neutral position or set the forward direction by actuation of the travel lever. In this case, it was assumed that the operator, upon coming into contact with an obstacle at the rear, releases the travel lever or that the holding force of the operator is less than the restoring force, initiated by the safety actuator, on the travel lever. However, it has been found that the holding force of the hand, in particular in a panic situation, can become enormous, so that the operator does not let go of the travel lever and, by further travel of the roller, a permitted maximum force of 230 newtons may be exceeded by the safety actuator in contact with the body of the operator. However, a higher loading than the admissible maximum force may alone result in considerable injuries to the operator.

In order to remove this problem, solutions in which, despite the force with which the operator takes a firm hold of the travel lever, a positive-locking connection between travel lever and the control line leading to the drive is unlocked by the safety actuator detecting the obstacle have been proposed. As a result, the spring-loaded control line jumps into the stop position. A disadvantage of this principle, however, is that the positive-locking connection between travel lever and control line can only be restored when the safety actuator displaced by the obstacle has again reached its initial or operating position, so that a coupling between travel lever and control line becomes possible again. Not until then is a movement of the roller in the opposite direction possible. To this end, however, the operator must have freed himself from his jammed position beforehand, since otherwise the safety actuator cannot be returned into the operating position.

OBJECTS AND SUMMARY OF THE INVENTION

The object of the invention is to specify a safety arrangement for a manually guided soil compaction roller, which safety arrangement, even if the operator frantically keeps a firm hold of the travel lever, permits reliable stopping of the roller and, on the other hand, permits forward travel of the roller away from the operator even if the safety arrangement has been triggered by travel of the roller against the operator.

According to the invention, the object is achieved by a safety arrangement having the features of patent claim 1. Advantageous developments of the invention can be gathered from the dependent claims.

In the safety arrangement according to the invention, in addition to the first coupling known per se, often designed as a jaw clutch, between a travel lever and an adjusting element connected to a control line, a second coupling is provided. The first coupling can be released by displacement of a safety actuator from an operating position into a hazard position. The second coupling, however, is retained even in this case, but can only transmit forces of the travel lever to the adjusting element if the travel lever is moved in the forward direction. This has the advantage that, if the roller runs into an obstacle and the safety actuator is actuated by the obstacle, e.g. the body of the operator, the first coupling is neutralized, as a result of which the adjusting element moves into neutral position in a spring-loaded manner and stops the roller. So that the operator can free himself from his emergency situation, he can put the travel lever, which at first is still in the reverse travel position, into the forward position. The movement of the travel lever in the forward direction is transmitted via the second coupling to the adjusting element and thus via the control line to the drive of the roller, so that the latter moves in the forward direction away from the operator and releases the latter.

The second coupling likewise preferably has a positive-locking clutch in which the adjusting element carries a driver, against which a stop provided on the travel lever can run. This ensures that forces can be transmitted only in one direction, namely the forward direction of the roller.

BRIEF DESCRIPTION OF THE DRAWINGS

These and further advantages and features of the invention are explained in more detail below with the aid of the attached figures, in which.

DETAILED DESCRIPTION OF THE PREFERRED EMBODIMENTS

Figure 1:
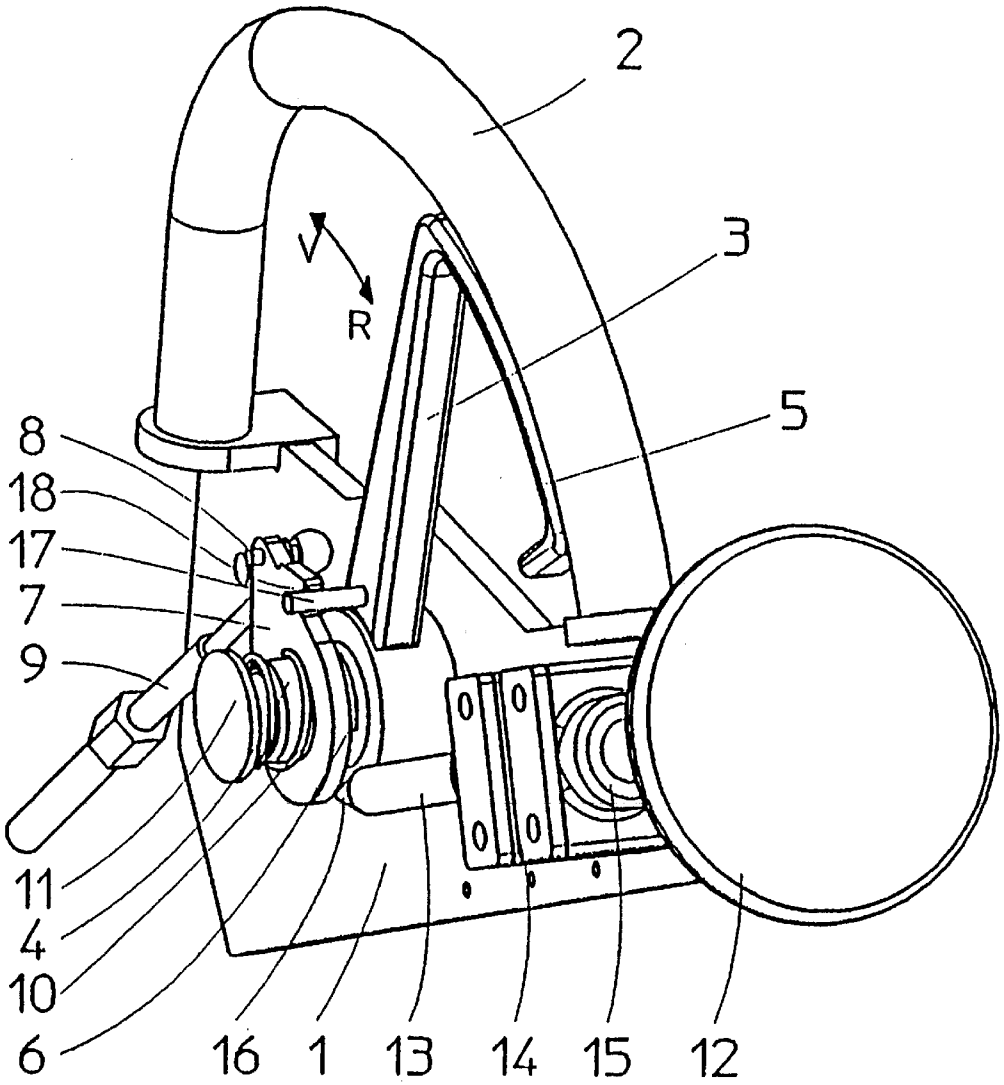
FIG. 1 shows a perspective view of a handle for a soil compaction roller with the safety arrangement according to the invention in the operating position.

The figures essentially show the same arrangement, but with different positioning of the elements. Therefore the construction of the safety arrangement according to the invention will first of all be described with reference to FIGS. 1 and 3. A description of the mode of operation then follows with reference to the further figures.

A handle 2 is fastened to a retaining plate 1 fastened to a pole (not shown) of a soil compaction roller, via which handle 2 the soil compaction roller can be guided in a conventional manner. In the arch of the handle 2, a travel lever 3 is arranged so as to be pivotable on a pivot 4. For ergonomical reasons, the travel lever 3 has an extension 5, which is designed in such a way that it can be grasped by the operator at the same time as the operator keeps a firm hold of the handle 2. The travel lever 3 is pivotable in the forward or reverse direction, a fact which is identified by arrows V and R.

Figure 3:
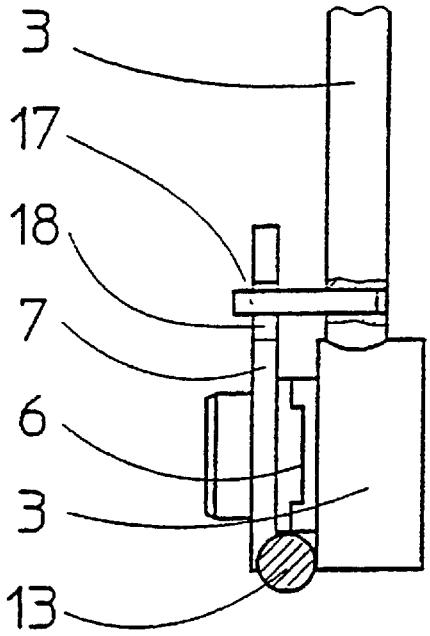
FIG. 3 shows a front view of the safety arrangement according to the invention in accordance with the position of FIG. 1.

The movement of the travel lever 3 can be transmitted to an adjusting element 7 via a jaw clutch 6, which can be seen in particular in FIG. 3 and serves as first coupling. The adjusting element 7 is likewise arranged so as to be pivotable on the pivot 4 and is pivotably coupled at one lever end 8 to the end of an actuating device 9 serving as control line. A drive (not shown) for the roller can be activated via the actuating device 9, which is designed, for example, as a Bowden cable. The drive is normally a hydraulic pump, the pumping capacity of which can be adjusted by means of the actuating device 9. Instead of a Bowden cable, a control linkage, for example, may also be used for the actuating device 9.

The adjusting device 7 is provided on one side with the jaw clutch 6 and is loaded on the other side by a spring 10, which is supported against a step 11 on the pivot 4.

As a result, the jaw clutch 6 is kept closed by spring loading, and the manual force, acting on the travel lever 3, of the operator is transmitted in a positive manner to the adjusting element 7 and the actuating device 9.

Furthermore, a safety actuator, which essentially comprises an impact pot 12, a plunger 13 and a guide 14, is arranged on the retaining plate 1. The impact pot 12 is firmly connected to the plunger 13 and, by means of a spring 15 supported against the guide 14, is held in an operating position, in which the control is not affected by the safety actuator. However, the plunger 13 is held in the guide 14 in an axially movable manner, so that the plunger 13 can be displaced with the impact pot 12 out of the operating position into a hazard position against the action of the spring 15 if the impact pot 12 runs, for example, into the body of the operator or another obstacle.

Figure 2:
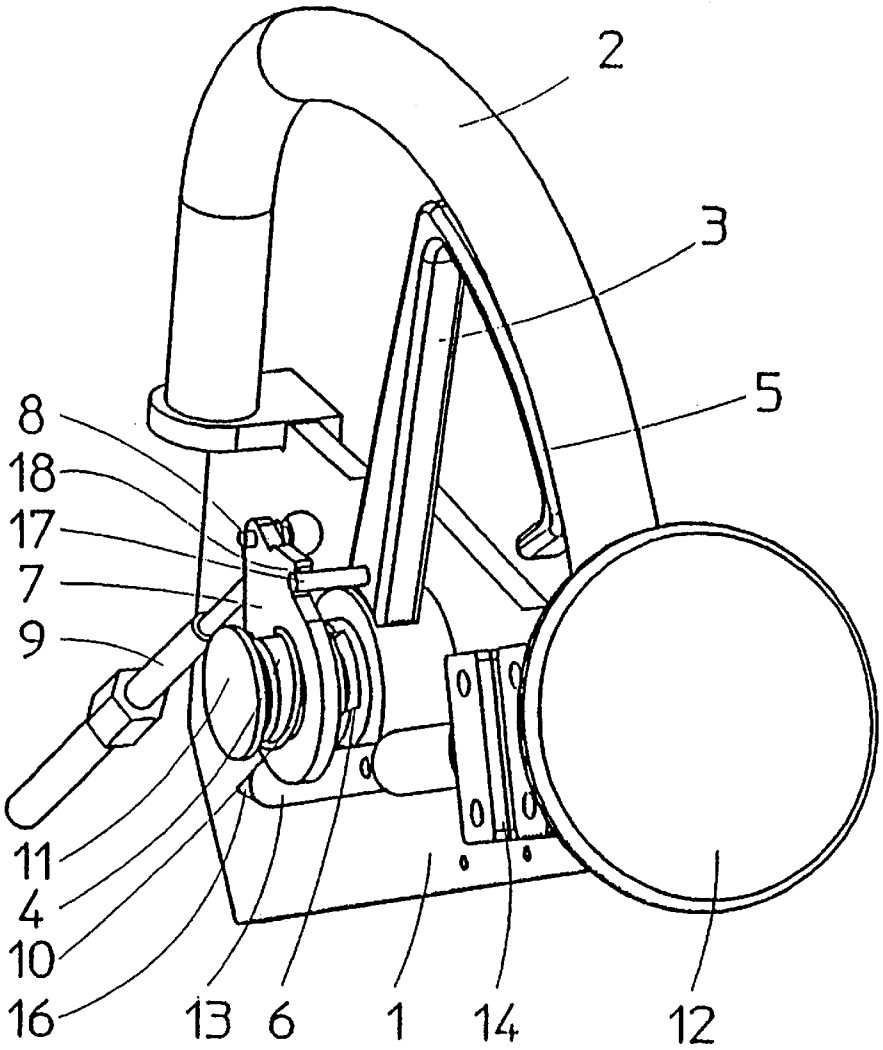
FIG. 2 shows the handle from FIG. 1 with the safety arrangement in hazard position.
Figure 4:
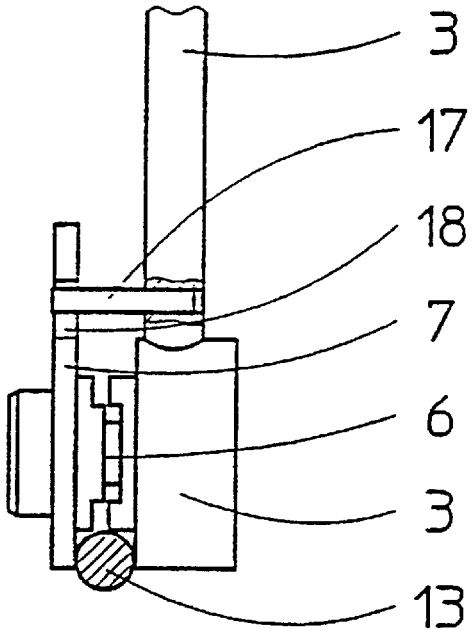
FIG. 4 shows a front view of the safety arrangement in accordance with the position of FIG. 2.

The hazard position is shown in FIG. 2. In this case, it can be seen that the impact pot 12 with the plunger 13 has been displaced in the forward direction V of the roller, i.e. in the direction of the jaw clutch 6. By the penetration of a conical point 16, formed on the plunger 13, between the two halves of the jaw clutch 6, i.e. between the adjusting element 7 and the travel lever 3, the adjusting element 7 is displaced axially against the action of the spring 10, whereupon the jaw clutch 6 is disengaged. As a result, the force flow between the travel lever 3 and the adjusting element 7 is neutralized. The adjusting element 7 is loaded by a spring device (not shown) in such a way that, when it is not loaded by the travel lever 3, it pivots automatically into neutral position, which corresonds to a stoppage of the roller. If the jaw clutch 6 is therefore disengaged, the adjusting element 7 automatically pivots into its neutral position and stops the travel of the roller via the actuating device 9. The disengaged clutch 6 is also shown in FIG. 4, from which it can clearly be seen that the plunger 13 lifts the adjusting element 7 from the travel lever 3.

However, the problem that the operator may already be jammed between the impact pot 12 and an obstacle is still not solved with the stoppage of the roller. In order to free himself, the operator, according to the invention, can therefore pivot the travel lever 3 in forward direction V. When the neutral position of the adjusting element 7 is reached, a positive-locking clutch serving as second coupling comes into engagement, this positive-locking clutch being formed by a pin 17 fastened to the travel lever 3 and a driver 18 formed on the adjusting element 7. The pin 17 extending in the axial direction of the pivot 4 is so long that it can reach the driver 18 even if the adjusting element 7 is disengaged by the plunger 13.

During forward movement of the travel lever 3, the pin 17 therefore presses against the surface of the driver 18 and pivots the adjusting element 7 in the forward direction. The movement of the adjusting element 7 is accordingly transmitted via the actuating device 9 to the drive of the roller, as a result of which the roller moves away from the jammed-in operator in the forward direction.

Instead of the arrangement of the second coupling shown in FIG. 1, it is of course also possible for the adjusting element 7 to carry a pin, against which the travel lever 3 runs during forward movement. In normal operation, it is in addition expedient for no contact to take place between the pin 17 and the driver 18 when the jaw clutch 6 is engaged. Instead of a pin 17 inserted into the travel lever 3 as shown in FIGS. 3 and 4, another stop may of course also be formed on the travel lever 3.

For better understanding, the abovedescribed mode of operation of the safety arrangement is explained below with reference to the side views shown in FIGS. 5 to 8.

Figure 5:
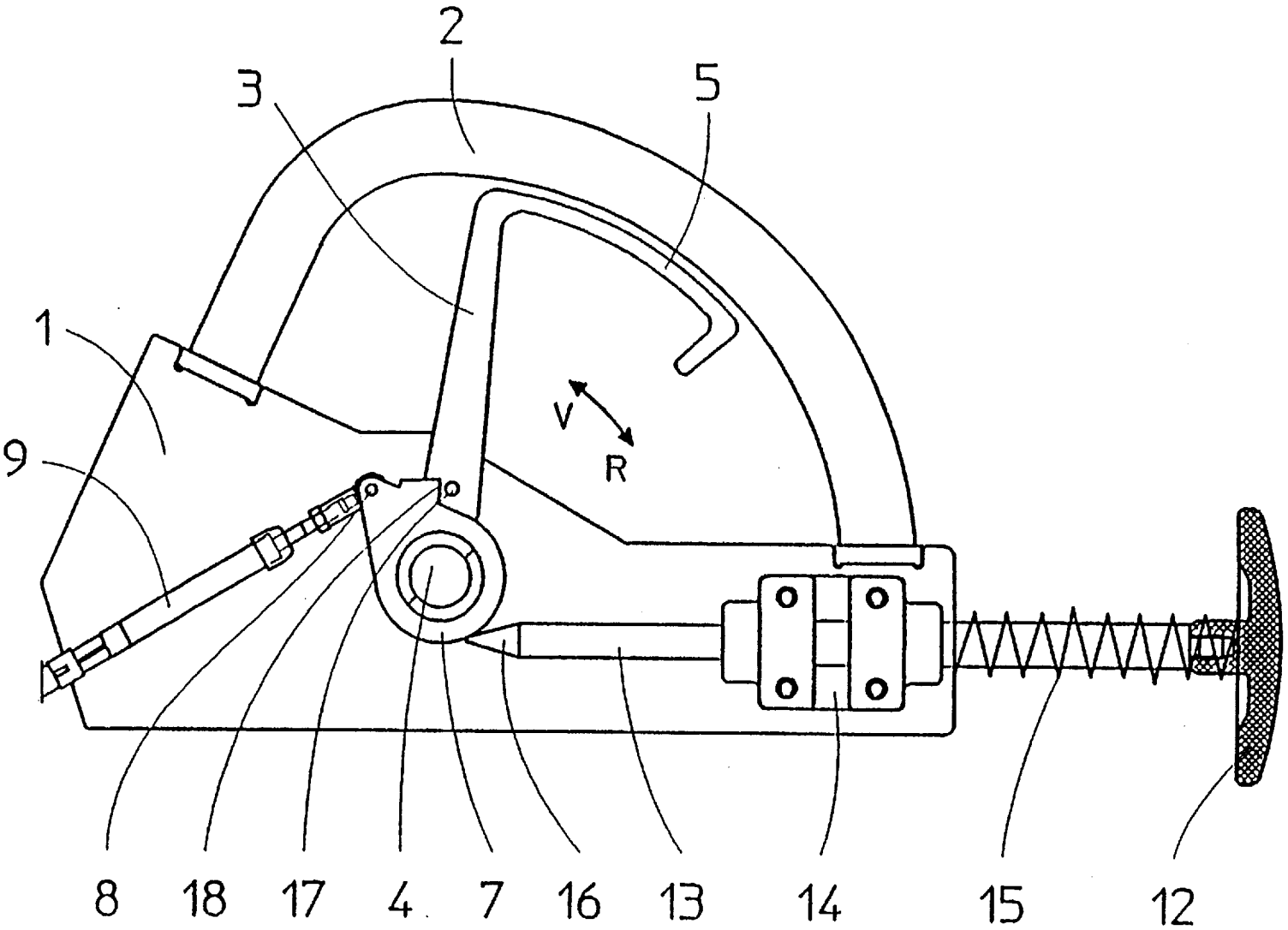
FIG. 5 shows a side view of the handle with the safety arrangement according to the invention and a travel lever in forward position.
Figure 6:
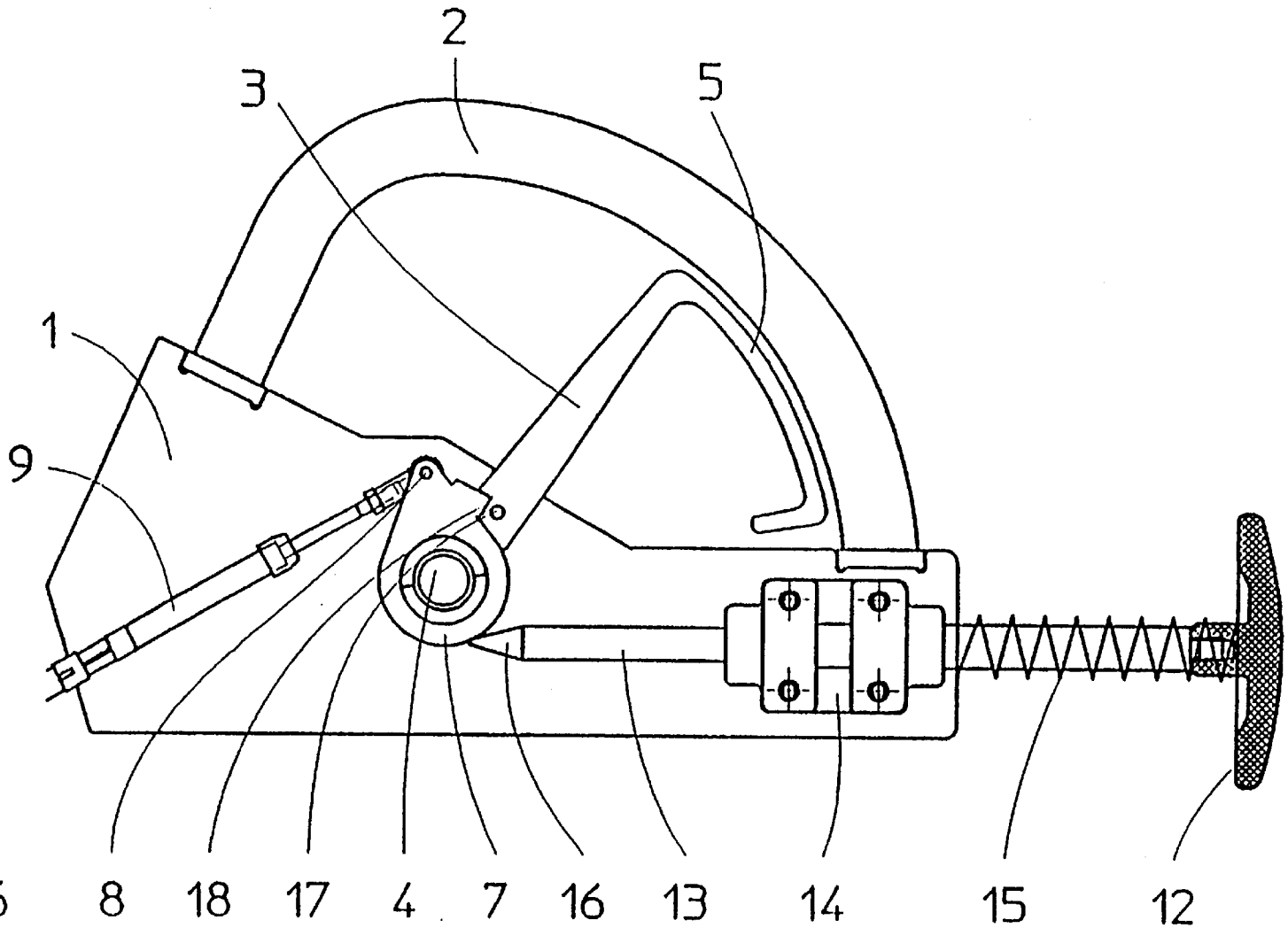
FIG. 6 shows a side view of FIG. 1 with the travel lever in reverse position.

FIG. 5 shows the travel lever 3 in the forward position and the safety actuator with the impact pot 12 in the operating position. Accordingly, FIG. 6 shows the travel lever 3 in reverse position. The position of the travel lever 3 is transmitted via the respectively engaged jaw clutch 6 to the adjusting element 7 and the actuating device 9, so that a reliable control of the roller drive is possible.

Figure 7:
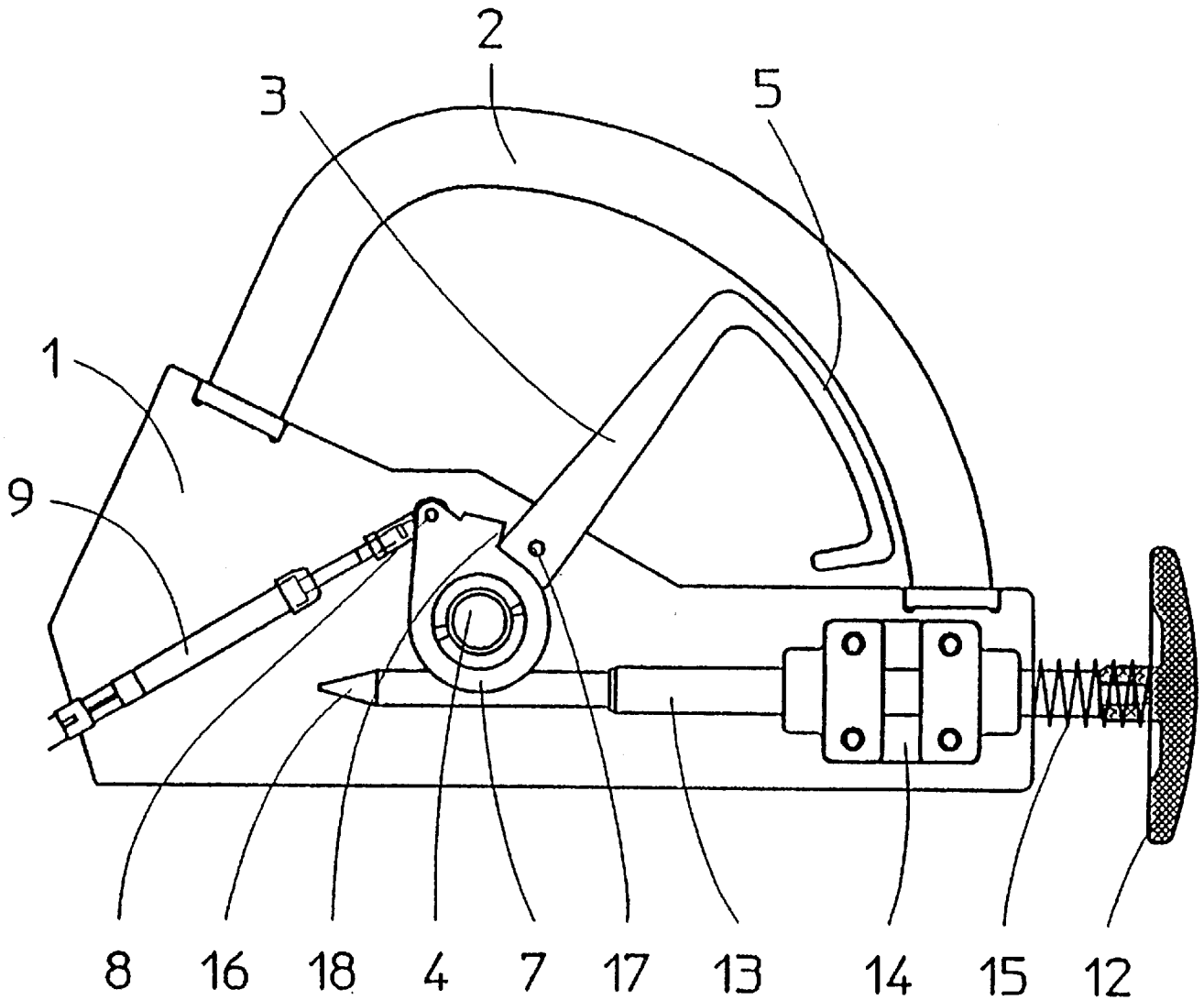
FIG. 7 shows a side view of FIG. 2 with travel lever in reverse position and safety actuator in hazard position.

FIG. 7 shows a state in which the roller was first of all in reverse travel due to the travel lever 3 located in reverse position and then an obstacle was detected via the impact pot 12. The plunger 13 has been pushed against the jaw clutch 6 and has released the latter. Accordingly, the spring-preloaded adjusting element 7 has pivoted into neutral position and stopped the drive via the actuating device 9. The machine is stopped in the state shown in FIG. 7.

Figure 8:
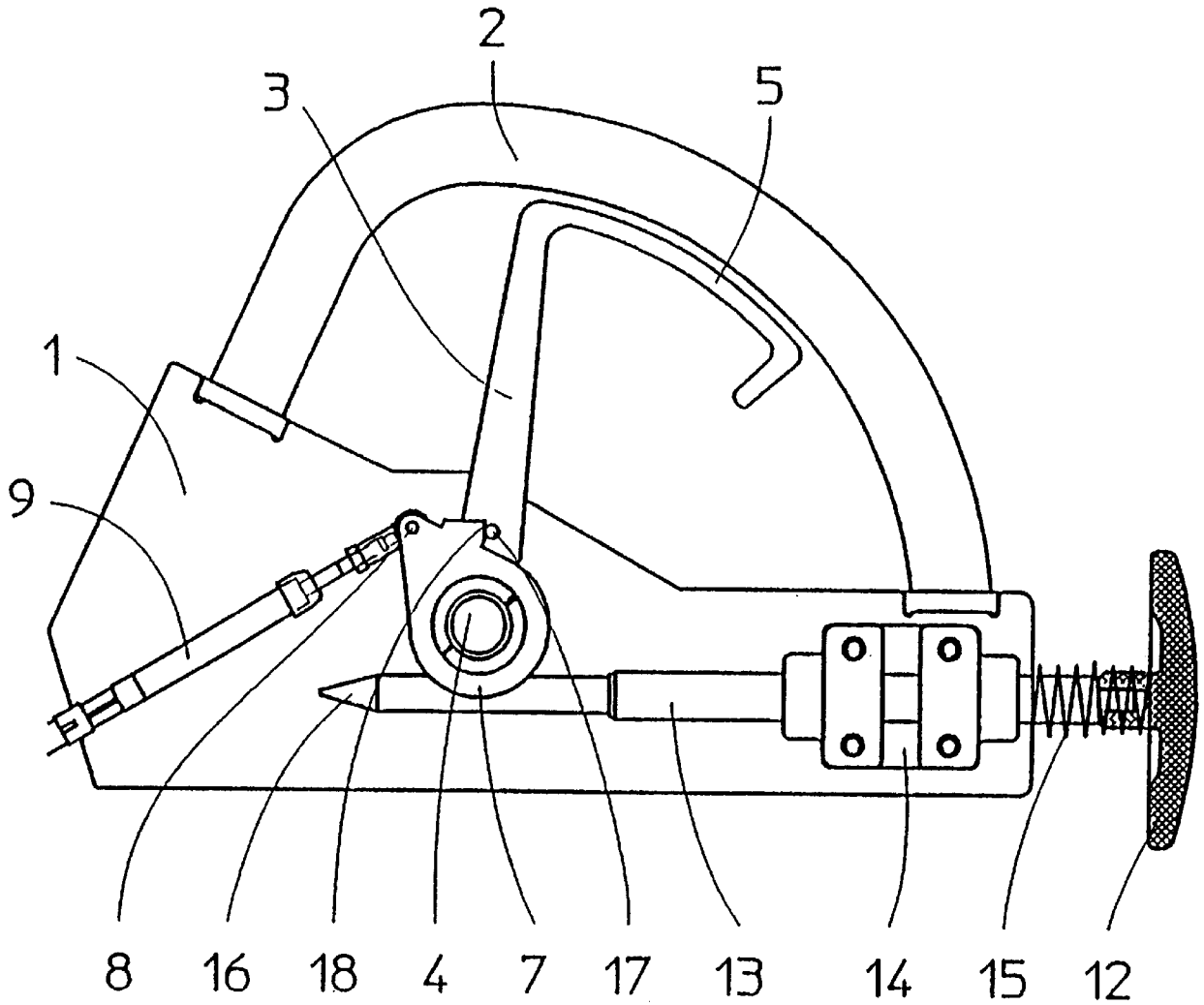
FIG. 8 shows a side view of the handle with travel lever in forward position and safety actuator in hazard position.

In the state shown in FIG. 8, the operator has pivoted the travel lever 3 in the forward direction V, so that the pin 17 has been able to run against the driver 18 of the adjusting element 7. By further movement of the travel lever 3 in forward direction V, the appropriate control command is transmitted via the actuating device 9 to the drive of the roller and the latter is driven in forward direction. By moving the roller away from the body of the operator, the impact pot 12 can return into its original operating position, whereupon the plunger 13 is displaced out of the jaw clutch 6 and the jaw clutch 6 can engage again. The original operating state is thus restored.

Apart from being used in rollers, the safety arrangement may of course also be used in other machines which are run with an operator in attendance.

What is claimed is:

1. A safety arrangement for a manually operated soil compaction roller, having a travel lever (3) determining the travel direction and speed and movable forward (V) and backward (R) as viewed in the travel direction of the roller;

an adjusting element (7) coupled to the travel lever (3) via a first coupling (6) and intended for transmitting the travel-lever position to an actuating device (9), the adjusting element (7), when not loaded by the travel lever (3), being preloaded in a center position corresponding to zero travel speed;

a safety actuator (12, 13) which is arranged so as to be movable between an operating position and a hazard position and is preloaded in the operating position and by means of which the first coupling (6) is separable in the hazard position; and a second coupling (17, 18) of travel lever (3) and adjusting element (7), by means of which, when the first coupling (6) is separated, forces can be transmitted only during forward movement of the travel lever (3).

2. The safety arrangement as claimed in claim 1, wherein the first and/or the second coupling has a positive-locking clutch.

3. The safety arrangement as claimed in claim 2, wherein the first coupling has a jaw clutch (6).

4. The safety arrangement as claimed in claim 3, wherein the adjusting element (7) is axially displaceable on a pivot (4) of the travel lever (3) against the action of a spring (10).

5. The safety arrangement as claimed in claim 4, wherein the adjusting element (7) is axially displaceable by the safety actuator (12, 13) in such a way that the jaw clutch (6) disengages if the safety actuator (12, 13) reaches its hazard position.

6. The safety arrangement as claimed in claim 1, wherein the second coupling has a driver (18) on the adjusting element (7), against which driver (18) a stop (17) provided on the travel lever (3) can run.

7. The safety arrangement as claimed in claim 6, wherein the stop is a pin (17), which is fastened to the travel lever (3) and extends parallel to the pivot (4) of the travel lever (3).

* * * * *